United States Patent [19]

Silverman

[11] 4,104,757

[45] Aug. 8, 1978

[54] POWER DRIVEN DRAIN CLEANER WITH SAFETY OVERLOAD CLUTCH

[76] Inventor: Arthur A. Silverman, 2245 Harmain Rd., Pittsburgh, Pa. 15235

[21] Appl. No.: 794,011

[22] Filed: May 5, 1977

Related U.S. Application Data

[63] Continuation of Ser. No. 710,552, Aug. 2, 1976, abandoned.

[51] Int. Cl.[2] ..... B08B 9/02

[52] U.S. Cl. ..... 15/104.3 SN; 81/52.4 A

[58] Field of Search ..... 15/104.05, 104.09, 104.1 R, 15/104.11, 104.12, 104.13, 104.14, 104.3 R, 104.3 SN; 81/52.4 A, 52.5; 192/56 R

[56] References Cited

U.S. PATENT DOCUMENTS

| | | | |
|---|---|---|---|
| 2,169,543 | 8/1939 | Sullivan | 15/104.3 SN |
| 3,574,878 | 4/1971 | Shames | 15/104.3 SN |
| 3,662,628 | 5/1972 | Schnepel | 81/52.4 A |

*Primary Examiner*—Edward L. Roberts
*Attorney, Agent, or Firm*—Carothers and Carothers

[57] ABSTRACT

A power driven drain cleaner which utilizes an elongated flexible sewer snake that is motor driven at one end and connected to a sewer cleaning head at the other end. An overload slip or escapement clutch is positioned between the sewer cleaning head and the adjacent free end of the sewer snake. The slip clutch is a spring loaded clutch which gives off vibration clicks when slippage is occurring within the clutch upon application of a predetermined torque created between the snake and the cleaning head. The vibration clicking action of the clutch acts as a feedback signal which is fed to the power driven end of the snake for detection by the person operating the power driven drain cleaner, to indicate an obstruction has been met by the cleaning head in the sewer line and maximum safe torque is being applied to the sewer snake.

4 Claims, 1 Drawing Figure

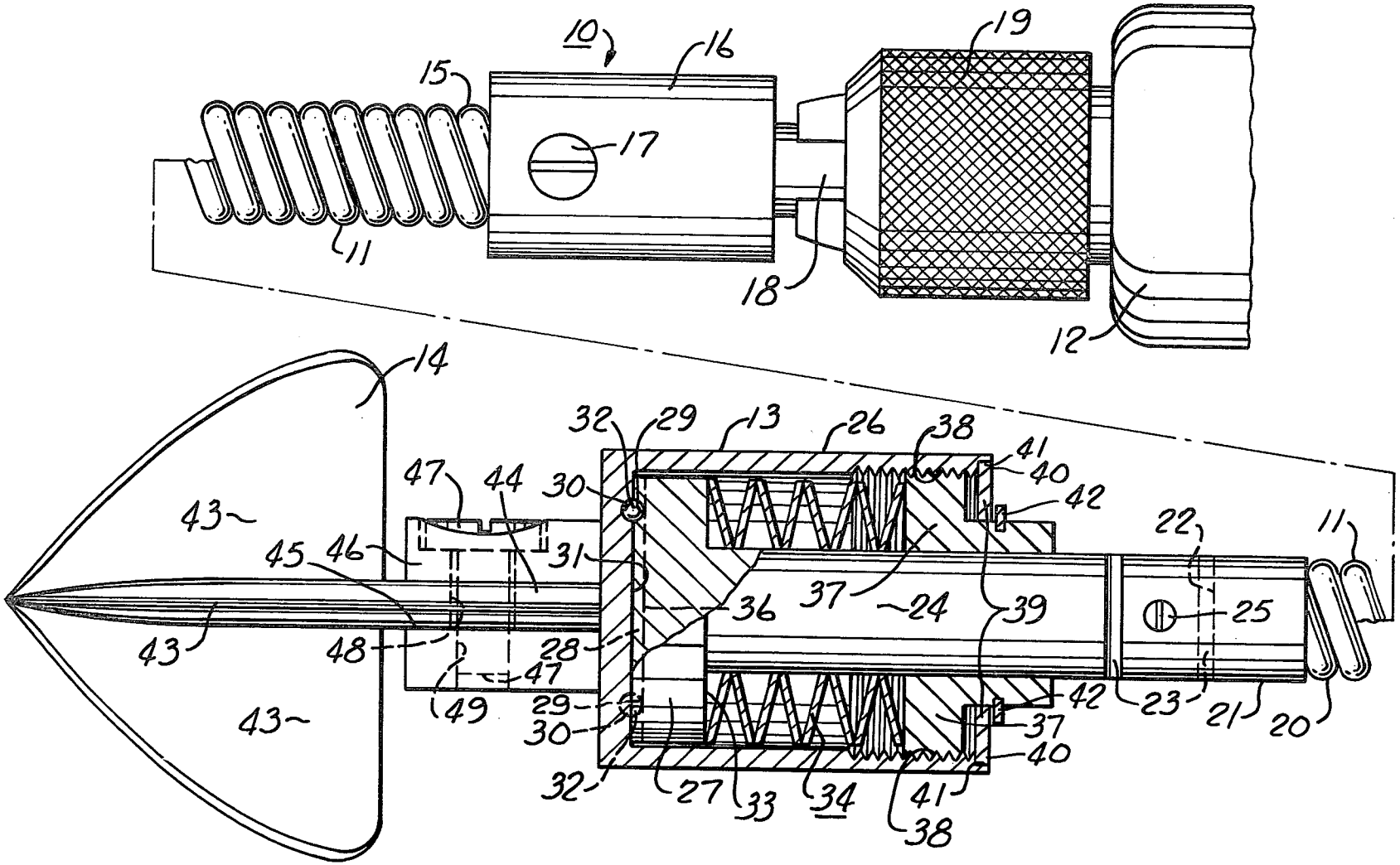
10
11
12
13
14
15
16
17
18
19
20
21
22
23
24
25
26
27
28
29
30
31
32
33
34
36
37
38
39
40
41
42
43
44
45
46
47
48
49

POWER DRIVEN DRAIN CLEANER WITH SAFETY OVERLOAD CLUTCH

CROSS REFERENCE TO RELATED APPLICATION

This is a continuation of application Ser. No. 710,552 filed Aug. 2, 1976 in Group 242, now abandoned.

BACKGROUND OF THE INVENTION

1. Field of the Invention

This invention relates generally to power driven drain cleaners and more particularly to power driven sewer snakes with safety overload clutches to prevent breakage or damage to the sewer snake.

2. Discussion of the Prior Art

The concept of power driven snakes for cleaning out clogged drains or sewer pipes is well known. Generally, an elongated flexible sewer snake which is formed of one or more helical wires is inserted into the drain pipe to be cleaned and at the same time rotated either by hand or most generally by an electric motor. A sewer or drain cleaning head is attached to the forward or free end of the flexible snake in order to cut away or clear the clogged portion of the drain pipe. A number of different types of cleaning heads are utilized depending upon the type of obstruction encountered. For example, a special cutter might be employed to cut through root obstructions, whereas a simple spiral shaped cleaning head might be utilized to force clogged material of a different type through the drain pipe. Most sewer snakes are adapted such that the sewer cleaning head may be readily changed to meet the particular situation.

A common problem which occurs in the use of power driven sewer snakes is breakage of the sewer snake itself or otherwise severely kinking the sewer snake such that it will not properly work due to the application of excessive torque being applied to the snake by the motor drive when the cleaning head or cutting head encounters an obstruction which severely limits or stops its rotational movement altogether. In this situation, severe torques are being applied to the long flexible snake because the cleaning head is not rotating at all. This excessive torque applied by the motor drive commonly causes the snake to permanently kink or completely break and sever, not only thereby rendering the sewer snake permanently damaged but generally the sewer cleaning head itself and a portion of the snake will remain in the sewer line being cleaned thereby further clogging the sewer line and creating the difficult problem of attempting to retrieve the broken off portion of the sewer snake from the sewer or drain pipe.

A number of attempts have been made in the past to eliminate this problem by providing a slip clutch at the power driven end of the sewer snake which permits slippage between the motor drive and the sewer snake when a predetermined torque has been attained. Examples of such devices are illustrated in U.S. Pat. No. 3,742,548 issued on July 3, 1973 and in U.S. Pat. No. 3,574,878 issued on Apr. 13, 1971.

While such slip clutches do decrease the possibility of breaking or otherwise damaging the sewer snake when the sewer cleaning head becomes jammed, they fail to eliminate the problem.

The reason for this is that as large lengths of sewer snake are being fed into the sewer or drain pipe, it is obvious that the total weight of the sewer snake itself being fed into the drain pipe also increases. It is accordingly further obvious that it takes more torque to rotate the sewer snake within the drain pipe with increased lengths.

In addition, as the sewer snake is being fed into the drain pipe, it also encounters many minor obstructions such as bends or turns in the sewer pipe itself which applies additional resistance to rotation of the sewer snake in proportion to the length of snake fed into the sewer or drain pipe. This also demands that additional torque be applied to the driven end of the sewer snake merely to keep the same rotating within the sewer or drain pipe.

The safety overload clutches of the prior art are generally a spring loaded type clutch wherein the torque setting at which the clutch will begin to slip may be preadjusted. These clutches are mounted adjacent the rotary motor drive so that they are easily accessible to the operator and may be periodically adjusted to change the torque setting at which they will begin to slip.

As previously indicated, as more snake is fed into the sewer line, more torque is applied to the sewer snake itself, and the result is that the safety overload clutch begins to slip. At this point, the operator stops the sewer snake motor drive and adjusts the safety overload clutch at a higher torque setting. The operator then starts the motor drive again and begins to feed additional snake into the sewer or drain pipe until such time that this occurs again, and the clutch begins slipping even though the sewer cleaning head at the free end of the snake has encountered no obstruction within the sewer line. Thus, again, the operator adjusts the clutch at an even higher torque setting to keep the sewer snake rotating even though no real obstruction has yet been encountered. It can be readily seen that this sequence of events repeats itself over and over until such time that the cleaning head at the free end of the snake finally does encounter an obstacle or obstruction which prevents the cutting head or cleaning head from rotating at all. However, by this time, the torque setting on the safety overload clutch is set so high that the sewer snake either permanently kinks so that it is no longer usable, or snaps or severs in any event, leaving the most difficult task of attempting to remove the broken portion of the snake and the cutter head or cleaning head from the sewer line. Not only is the cost of the sewer snake itself lost, but also the expense incurred time-wise in retrieving the broken snake from the drain pipe.

It is the principal object of the present invention to eliminate the aforesaid disadvantages of the power driven sewer snakes of the prior art.

SUMMARY OF THE INVENTION

The inventive combination for the power driven drain cleaner of the present invention comprises an elongated flexible sewer snake for attachment at one end to a rotary power drive and a sewer cleaning head secured to the other or free end of the snake. An overload slip clutch is interposed at the said other or free end of the snake adjacent the sewer cleaning head, as opposed to the overload clutches of the prior art which are all positioned at the power driven end of the snake. The slip clutch permits slippage therein upon application of a predetermined torque to the slip clutch, which is created between the snake and the cleaning head. In addition, feedback means is provided for transmitting a feedback signal back to the driven end of the sewer snake when the clutch is slipping so that the operator may thereby readily detect that the cleaning head has hit an obstruction and maximum torque is being applied to the sewer snake.

This feedback means is preferably provided in the form of vibration clicks created by slippage of the clutch itself. These vibrations and clicking sounds are thus transmitted back through the sewer line and through the sewer snake itself so that they may be felt and/or heard by the operator thereby notifying him that the clutch is slipping.

The slip clutch is preferably an adjustable spring loaded type wherein the torque setting at which is will slip may be readily varied prior to insertion of the snake into the sewer or drain pipe. Thus, the slip clutch may be preadjusted so that it will not slip until a predetermined maximum torque is applied thereto. This torque adjustment is set to conform with the maximum torque which the sewer snake itself will take without becoming damaged or breaking.

In addition, a coupling means is provided between the slip clutch and the adjacent sewer cleaning head to permit attachment of different types of cleaning heads as may be required.

The combination of the present invention provides a power driven sewer snake with a safety overload clutch which will prevent damage or snapping of the sewer snake no matter how much line or sewer snake has been fed into the sewer or drain pipe. Since the overload clutch is placed adjacent the cleaning head or cutting head, the clutch will slip as soon as the cleaning head becomes jammed and applies the predetermined torque to the clutch. The sewer snake is never subjected to a torque greater than that which it can withstand without breaking or becoming damaged, because the long sewer snake is not disposed between the clutch and the cleaning head. Accordingly, the disadvantages previously mentioned with regard to the prior art power driven drain cleaners cannot occur.

BRIEF DESCRIPTION OF THE DRAWING

Other objects and advantages appear in the following description and claims.

The accompanying drawing shows, for the purpose of exemplification without limiting the invention or the claims thereto, certain practical embodiments illustrating the principles of this invention.

The attached drawing is a broken view in partial section of the power driven drain cleaner combiation of the present invention in side elevation.

DETAILED DESCRIPTION OF THE DRAWING

Referring to the drawing, the power driven drain cleaner 10 consists of an elongated flexible sewer snake 11 (shown with the major portion thereof removed), electric motor power drive 12, slip or escapement clutch 13, and the sewer cleaning head or cutter head 14. 3,691,583

The sewer snake 11 may consist of a single long length of sewer snake or it may consist of a series of connected sewer snakes. For simplification, the sewer snake 11 in this instance is illustrated as being connected directly to the motor drive 12. However, realistically, extra sewer snake to be fed into the pipe line is stored in a coiled manner within a drum and fed out as required. Such a device is illustrated in U.S. Pat. No. 3,691,583 issued Sept. 19, 1972. Generally, a power drive and sewer snake feed as illustrated in this Patent would be employed.

Sewer snake 11 is constructed of helically wound spring wire. Other conventional sewer snake lines may be employed. For example, some sewer snake lines are constructed of two helical but oppositely wound wire lines, one coaxially inserted within the other, and still others are constructed such that one helical wound wire is provided with a cable or chain within the hollow helical core to strengthen the torque capabilities of the snake.

The power driven end 15 of the snake 11 is received within the hollow end of driver connection 16 and therein clamped by means of set screw 17, which threadably penetrates through the cylindrical wall of driver coupling 16. Driver coupling 16 is in turn provided with a rearwardly extending chuck stem 18 which is clamped in the jaws of chuck 19 for electric rotary drive provided by the motor 12. In the figure, only the front portion of motor 12 is illustrated. However, motor 12 is generally a conventional variable speed electric drill motor. The present invention is, of course, also compatible arrangement, larger power driven drain cleaners.

The free end or forward end 20 of sewer snake 11 is provided with a rigidly secured coupling member 21. Coupling member 21 is generally of a cylindrical outer configuration, and at its forward end is provided with a transverse diagonal slot 22 which in turn receives the tongue 23 of the elongated shank 24, which in turn is the driver for slip or escapement clutch 13. This spline coupling arrangement between coupling member 21 and shank 24 is maintained by means of set screw 25 which is threadably received within coupling member 21 and passes through an opening in tongue 23. With this arrangement, a new snake 11 may be readily attached to clutch 13.

Clutch 13 may be readily found on the present day market, and is marketed under the Trademark "Perf-a-Torq" by The X-4 Corporation. Other clutches may be substituted. For example, the clutch illustrated in U.S. Pat. No. 3,574,878 (previously mentioned) may also be used as well as a spring loaded jaw type clutch of the type illustrated in U.S. Pat. No. 3,742,548 (previously mentioned).

The prime prerequisites of clutch 13 are that the torque at which the clutch slip may be preadjusted, and secondly that when slippage occurs within the clutch, vibration clicks or ratchetting are created in order to transmit vibrations and/or clicking noises back through the sewer line in which the snake is inserted, or through the snake 11 itself, so that these vibrations and/or clicks may be readily detected by the operator at the power driven end of the snake. The operator thus immediately knows that sewer cleaning element 14 is jammed and that maximum allowable torque is being imparted to the snake 11. At this point, the operator can pull the snake and cleaning element out of the sewer line and attach a different type of cleaning head 14, or he may simply back the snake and cleaning head up a short distance and make another attempt at breaking through the obstruction.

The slip or escapement clutch 13 illustrated in the figure consists generally of the outer cylindrical housing 26, which is the driven part of the clutch, and driver shank 24 which is the driving portion of the clutch 13.

Elongated driver shank 24 is provided at its forward end with the enlarged annular driver head 27. The front face of driver head 27 is provided with a plurality of semi-spherical indentations 29 which are uniformly and annularly spaced about the annular face 28. A corresponding number of cooperating indentations 30 are also provided in the opposing face 31 of driven housing 26. Each of these cooperating indentations 29 and 30 correspondingly receives respective ball bearings 32.

The spring pressure is continually applied against the rear annular face 33 of the enlarged driver head 27 by means of spring 34 which is constructed of a series or plurality of stacked frusto-conical spring washers which are alternately reversed in their direction of frusto-conical extension. The amount of pressure applied by spring 34 against driver head 27 determines the torque at which driver head 27 will eventually begin to rotate relative to driven clutch housing 26. When such slippage occurs, the torque applied between housing 26 and driver head 27 is sufficient to cause driver head 27 to ride up over or on top of ball bearings 32 such that ball bearings 32 are no longer seated in indentations 29 in the front or forward face 28 of head 27. At this point, spring 34 is thus further compressed due to the fact that driver head 27 has been moved rearward a small extent as indicated at 36 in order to permit face 28 to ride over the surface of ball bearings 32.

As driver head 27 continues to rotate, the indentations 29 will finally align themselves with the next ball bearing 32 which remains seated in indentations 30. At this point, driver head 27 will snap or click back into its original seated position as ball bearings 32 are again received within indentations 29.

When continuous slippage therefore occurs, a continual clicking vibration will be given off by this ratchet effect of driver head 27 being continually and sequentially seated and unseated which provides the feedback means for detection by the operator due to the clicking noise and vibration given off by this effect.

The predetermined torque at which clutch 13 will begin to slip depends directly on the force being applied by spring 34. This is easily adjusted by means of the annular collar as indicated at 37. Elongated drive shank 24 is permitted to rotate relative to collar 37. Collar 37 is in turn held in position or fixed relative to housing 26 by means of end plate 39. Annular end plate 39 is keyed into collar 37 (not shown) so that collar 37 is not permitted to rotate relative to end plate 39. End plate 39 is in turn provided with a plurality of perimetally positioned protrusions 40 which key into corresponding key indentations 41 of housing 26. This prevents end plate 39 from rotating relative to housing 26. The result is that once position of collar 37 has been set by threadably advancing it into housing 26 to a desired position in order to give the desired predetermined compression or force which spring 34 applies to driver head 27, collar 37 is then fixed at this position relative to housing 26 by next inserting end plate or ring 39 into position. This entire assembly is then maintained in its assembled form by means of snap ring 42, which is received in a corresponding annulr recess in the outer stem portion of collar 37.

The cleaning head or cutter element 14 consists of four cutter blades 43 which extend radially outward from the axial center of the head. One of the blades 43 is provided with a rearwardly extending connection tongue 44 that is received in a corresponding slot 45 of the cylindrical forward shank portion 46 of housing 26. This coupling between the cleaning head 14 and the clutch 13 is maintained by means of set screw 47 which passes through opening 48 in tongue 44 and is then threadably received as indicated at 49 in the opposite half of cylindrical member 46.

By merely removing set screw 47, the cleaning head 14 may thus be readily changed.

I claim:

1. In a power driven drain cleaner, the combination comprising: an elongated flexible sewer snake for attachment at one end to a rotary power drive and a sewer cleaning head secured to the other end of said snake; the improvement consisting of an overload slip clutch interposed at said other end of said snake adjacent said sewer cleaning head to permit slippage of said clutch upon application thereto of a predetermined torque created between said snake and said cleaning head, and feedback means for transmitting feedback signals to said one driven end of said snake when said clutch is slipping for detection.

2. The power driven drain cleaner of claim 1 wherein said slip clutch is a spring loaded clutch which creates vibration clicks when slipping thereby providing said feedback means.

3. The power driven drain cleaner of claim 1 wherein said slip clutch is provided with adjustable torque setting means to permit preselected variation of said predetermined torque.

4. The power driven drain cleaner of claim 1 including coupler means between said slip clutch and said cleaning head to permit attachment of different sewer cleaning heads respectively.

* * * * *